United States Patent [19]

Gresh

[11] 4,135,260

[45] Jan. 23, 1979

[54] RINSE SINK SKIMMER

[76] Inventor: Peter P. Gresh, 389 Linwood Dr., Miami Springs, Fla. 33166

[21] Appl. No.: 781,586

[22] Filed: Mar. 28, 1977

[51] Int. Cl.[2] ..... E03C 1/244

[52] U.S. Cl. ..... 4/201; 4/206

[58] Field of Search ..... 4/201, 198, 199, 200, 4/206, 1, 172, 172.17; 137/362, 593; 210/169

[56] References Cited

U.S. PATENT DOCUMENTS

| | | | |
|---|---|---|---|
| 740,737 | 10/1903 | Blum | 4/201 |
| 2,321,176 | 6/1943 | Bloch | 4/206 |
| 2,374,642 | 5/1945 | Bloch | 4/206 |
| 2,884,650 | 5/1959 | Cooper | 4/206 |
| 2,988,755 | 6/1961 | Roland | 4/201 |
| 3,497,878 | 3/1970 | Emery | 4/206 |

*Primary Examiner*—Stuart S. Levy

[57] ABSTRACT

A rinse sink skimmer having a stopper portion to be positioned over a drain opening in the lower portion of a rinse sink and a skimmer device with a lip and a hanger to suspend it from the sink wall and wherein a tubular portion connects the skimmer to the plug in fluid communication so that water flowed over the lip at the water level in the sink will flow through the tubular length and out the drain opening at the plug.

2 Claims, 3 Drawing Figures

RINSE SINK SKIMMER

BACKGROUND OF THE INSTANT INVENTION:

This invention provides a skimmer device for use on kitchen sinks and a device which is simple to install and is adapted to fit any of many varied size sinks of the type conventionally used in rinsing dishes in a dishwashing operation. In the past, there have been numerous overflow attachments for sinks. Representative prior art is that found in U.S. Letters Pat. No. 2,065,347 which is of an attachment for use in rinsing tubs and an upwardly extending refuse cup and drain; U.S. Letters Pat. No. 2,884,650, which is for a tub overflow, and which is of the type which fits certain size tubs only and connects over the side of the tub and includes a downwardly extending tube from an upper collector for connection to the drain opening vertically below the connection to the tub wall; U.S. Letters Pat. No. 2,988,755 which is of a spill plug with an upwardly extending centrally arranged tubular portion having an enlarged upper mouth and which is received in the drain opening. U.S. Letters Pat. No. 3,289,218 which is of an attachment for sinks such as used in restaurants and taverns for disposing of the contents of drinking glasses and is for directing the contents of incompletely-emptied drinking glasses into the drain facilities and it is intended to isolate the rinsing water from the refuse. The instant invention relates to the problem, long recognized and referred to in the references cited above. The instant invention differs from the prior art in that it is composed of three sections which are interconnected and are adapted to fit a wide range of sink configurations, being composed of a stopper member which fits over the drain and a skimmer member which is arranged in supported relation on the side of the sink wall and a connector member to connect the skimmer and the stopper to flow skimmed water through the device to continually remove scum from the surface of the rinse water.

Generally, an object of this invention is to provide an improved skimmer for sinks which is adapted to fit a wide variety of sinks and which is as described more fully hereinafter.

In accordance with these and other objects which will become apparent hereinafter, the instant invention will now be described with reference to the accompanying drawings in which.

DESCRIPTION OF PREFERRED EMBODIMENT

Figure 1:
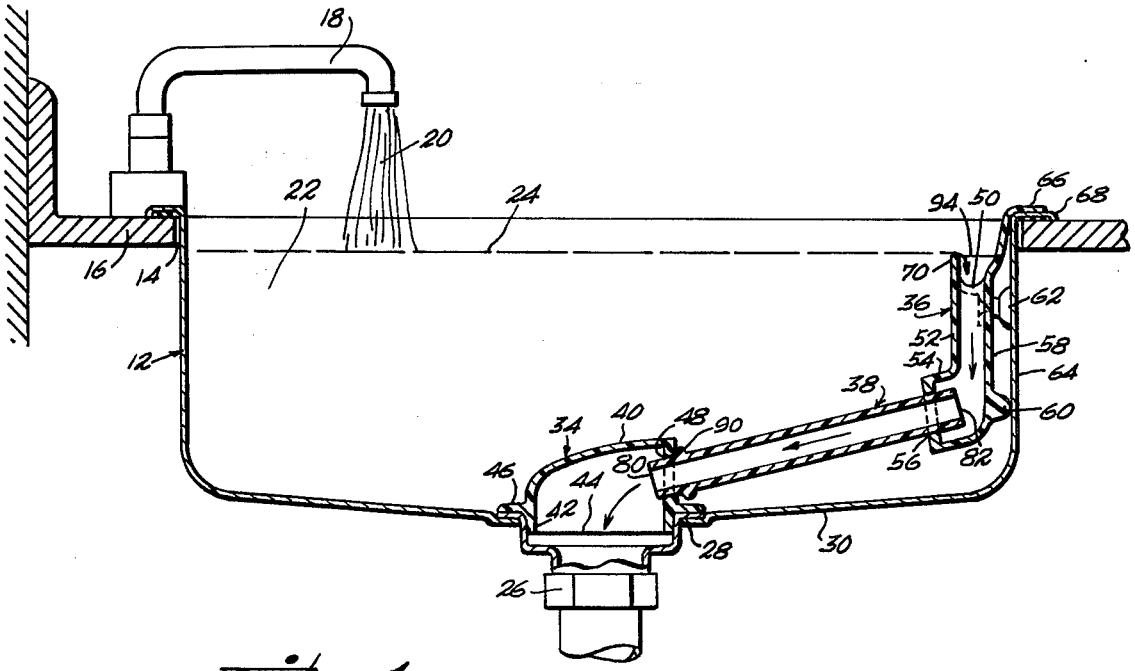
FIG. 1 is a side elevation view in cross section and illustrating the use of the instant invention.
Figure 2:
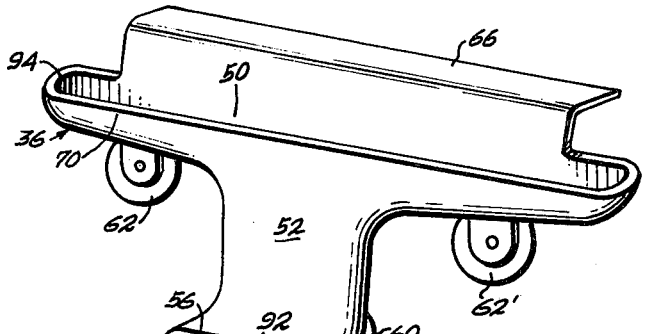
FIG. 2 is a perspective view of the invention.
Figure 3:
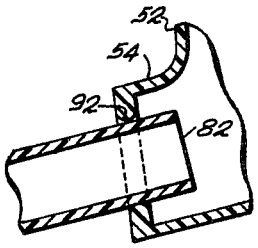
FIG. 3 is an enlarged view of the lower right-hand portion of FIG. 1.

Referring to the drawings wherein like reference characters designate like or corresponding parts throughout the several views and referring particularly to FIG. 1, there is shown a conventional sink 12 arranged in an opening 14 of a countertop 16 provided with plumbing and a faucet as indicated at 18 so that water 20 may fill it as at 22 and, when used with this invention, to the water level as indicated by the numeral 24. Suitable plumbing and drain connections as at 26 are provided and connected to an opening 28 in the floor 30 of the sink. The instant invention is composed of three principal parts: a stopper 34 to fit over the sink opening, a skimmer 36, and a connector portion 38 which in the illustrated embodiment is a separate piece interconnecting the stopper and skimmer. As shown, the stopper includes an upper portion 40 and an annular depending skirt 42 with an open end as at 44 with the annular skirt 42 sized for receipt in the opening 28 of the sink drain. The stopper is suspended on an annular flange 46; and an opening 48 is provided in the upper portion of the stopper to insert one end of the connector 38. The skimmer 36 has an open upper end, as at 50, and includes a downwardly extending portion 52 terminating in an outturned portion 54 with an opening 56 to insert the other end of the connector 38. On the rear wall 58 of the skimmer portion 52 there are lower feet as at 60 and upper suction type pads 62 and 62' which abut the sink wall 64 providing support when a flange 66 on the upper end is engaged over the flange 68 of the sink, it being noted that the front wall 70 of the skimmer terminates at the water level 24 of the sink and somewhat below the level of the portion 66. The connector portion 38 includes a first end 80 and a second end 82 which are sized respectively for receipt in the openings of the stopper and skimmer. In the preferred embodiment, the connector length 38 is of flexible pliable material which is adapted to be bowed slightly for interconnecting the members and the same may be provided with an annular ridge or rib 90 adjacent the end 80 to limit penetration. The rim of the mouth of the opening 56 is preferably rounded as shown in FIG. 3, the rim being designated by the numeral 92.

It is thus seen that there is provided a dishwater skimmer which is especially useful in utilizing a dual sink, of the type which includes one portion for washing and one portion for rinsing. The device is adapted to be positioned, as shown in the drawings, in the rinse water sink. The dishes are washed in a conventional manner and then put into the rinse water compartment. Any scum which floats to the surface of the water will be continually urged across the water level and over the lip 70 draining downwardly through the relatively wide collector mouth 94 and through the central downwardly extending portion 52, across the tubular length 38 and out through the drain opening. In this manner, the water is constantly kept moving and soap-free by the skimming action of the instant invention. The stopper may be of soft rubber and the preferred embodiment illustrated utilizes a tube of oval shape generally paralleling the floor of the sink while the height of the skimmer flange 66 assures a predetermined depth of location of the lip of the skimmer over which the water flows. The amount of waterflow required to cause the soapy water to move toward the skimmer and drain is selected by a user. It will be noted that the lip or annular flange 46 of the stopper, in a soft rubbery material embodiment, is held in place by the water pressure and the support feet 60 and 62 and 62' hold the skimmer in a correct location on the side of the sink acting as orienting means. The annular rib 90 on the length of tube which engages in the opening in the stopper prevents the tube from slipping into the housing of the stopper body while the skirt centers the stopper and that by reason of the structure described above the instant invention is adapted to be utilized with a wide range of sink designs, the only substantial variable being the length of the connector link 64, which may be simply cut with a scrissors to adapt the device for any of a wide range of sinks.

What is claimed is:

1. For a sink having a drain opening in a lower portion and an upwardly extending side wall, a skimmer device comprising:

a plug means sized to nest over the drain opening and having a hollow interior with a first opening in fluid flow communication with the drain opening and a second opening facing away from the drain, a skimmer including an open tapped, elongated upper lip and an upwardly extending hanger means to hang the lip to the sink wall and said skimmer including a downwardly extending tubular portion including a relatively long downwardly extending front face in depending relation of said skimmer and a rear and side wall, and said front face and walls converging downwardly to an exit opening, and a tubular connector length having a first end and a second end, said first end being connected to the exit opening of the skimmer and said second end being connected to the second opening of the plug, wherein the first end and the second end of said tubular length are sized for telescopic receipt in said exit opening of the skimmer and the second opening of the plug repsectively and wherein an annular rib is provided on said tubular connector length adjacent the terminal end and comprises limit means to limit penetration of said tubular length in said second opening of the plug, and orienting and stabilizing means are provided on said rear skimmer face to engage the wall of the sink, wherein said orienting means includes a pair of upper and a pair of lower members extending generally perpendicularly away from said rear face whereby scum floating to the surface of the water in the sink will be skimmed by flowing over the elongated, open tapped lip of the skimmer and through the drain opening.

2. The device as set forth in claim 1 wherein said hanger means includes a flange portion extending upwardly of said skimmer and above the level of said lip a predetermined distance.

* * * * *